US008632022B2

(12) United States Patent
Potter

(10) Patent No.: US 8,632,022 B2
(45) Date of Patent: Jan. 21, 2014

(54) SPRAY GUIDE

(76) Inventor: Terry Potter, Winter Garden, FL (US)

( * ) Notice: Subject to any disclaimer, the term of this patent is extended or adjusted under 35 U.S.C. 154(b) by 726 days.

(21) Appl. No.: 12/204,798

(22) Filed: Sep. 4, 2008

(65) Prior Publication Data

US 2009/0152378 A1 Jun. 18, 2009

Related U.S. Application Data

(63) Continuation-in-part of application No. 11/849,677, filed on Sep. 4, 2007, now abandoned.

(51) Int. Cl.
*B05B 7/02* (2006.01)

(52) U.S. Cl.
USPC ..... 239/526; 239/104; 239/288; 239/521; 239/587.5; 239/587.6; 118/504; 118/323

(58) Field of Classification Search
USPC ..... 239/104, 438, 539, 587.1, 503–505, 239/525, 526, 532, 288, 587.5, 587.6, 750, 239/754, 518, 521; 118/323, 504–505
See application file for complete search history.

(56) References Cited

U.S. PATENT DOCUMENTS

| | | | | |
|---|---|---|---|---|
| 4,085,703 A | | 4/1978 | Glowacki | |
| 4,248,914 A | | 2/1981 | McClane | |
| 4,974,532 A | * | 12/1990 | March | 118/504 |
| 5,022,586 A | * | 6/1991 | Putnam | 239/71 |
| 5,103,762 A | | 4/1992 | Long et al. | |
| 5,340,026 A | * | 8/1994 | Woodruff | 239/104 |
| 5,372,389 A | * | 12/1994 | Tam et al. | 285/94 |
| 6,619,569 B2 | * | 9/2003 | Jens | 239/526 |
| 6,976,644 B2 | * | 12/2005 | Troudt | 239/587.1 |
| 7,063,275 B2 | * | 6/2006 | Byron | 239/288 |
| 7,337,990 B2 | * | 3/2008 | Kurosaka et al. | 239/587.2 |
| 2005/0035221 A1 | | 2/2005 | Gathright | |
| 2007/0001036 A1 | * | 1/2007 | Siernos et al. | 239/754 |

* cited by examiner

*Primary Examiner* — Steven J Ganey
(74) *Attorney, Agent, or Firm* — Timothy H. Van Dyke; Beusse, Wolter, Sanks, Mora & Maire, P.A.

(57) ABSTRACT

A spray guide is disclosed herein for implementation a spray assembly comprising a spray wand and a spray nozzle. The spray guide includes an arm having a first end and a second end. A mechanism is used for removably attaching the first end of the arm to the swivel angle head, so that the arm will extend over the swivel angle head and the spray nozzle. A wheel is also provided. Another mechanism is provided for rotatably connecting the wheel to the second end of the arm. When an edge of the wheel is placed in a corner joint between a wall and a ceiling and the spray want manually moved therealong, the wheel will rotate in the corner joint to allow paint to be evenly sprayed from the spray nozzle onto an area of the wall adjacent to the ceiling. Also disclosed herein is a spray nozzle assembly for use with a handheld sprayer. Further, a spray guide designed for minimizing overspray is also disclosed herein.

3 Claims, 9 Drawing Sheets

SPRAY GUIDE

RELATED APPLICATIONS

This application is a continuation-in-part of U.S. Ser. No. 11/849,677 filed Sep. 4, 2007 now abandoned.

FIELD OF THE INVENTION

The present invention relates to a paint sprayer accessory, and more particularly, a paint spray guide.

BACKGROUND

The conventional way of painting edges, especially wall edges near a ceiling is a very tedious, arduous process. It requires that a painter use a paint sprayer in one hand and a long handle paint shield in another hand. The painter must climb up a ladder with these two items in his hands, and paint a wall that he can reasonably reach. Then the painter must climb down the ladder, move it and climb back up to paint another region of the wall. This dramatically increases the time it takes a painter to paint, resulting in a much lower productivity and earning potential for the painter.

U.S. Patent Office Document No. 4,085,703, Published/Issued on May 25, 1978, to Glowacki teaches spray painting shield that includes a flat reinforcing member attached to an elongate handle. The shield permits a painter or his assistant to support the shield while keeping his arms and hands out of the spray pattern. The reinforcing member is attached to rotate relative one end of the handle. A spring clip mounted on the reinforcing member is used to hold large flat shields, many of which are disposable, for preventing paint from falling on selected areas. The flat shields may be cut or combined to conform with the perimeter of protected items, and the reinforcing member may conveniently include a metal edge used for scraping or occasional brush work.

U.S. Patent Office Document No. 4,248,914, Issued on Feb. 3, 1981, to McClane discloses a method of utilizing a spray painting shield comprising a large, flat flexible masking blade attached to an elongated handle. Placing the front edge of the shield along a corner edge formed by a surface to be painted and an adjacent surface. Pushing the handle to flex the blade to about 40 degrees-80 degrees with respect to the edge and adjacent surface.

U.S. Patent Office Document No. 5,103,762, Issued on May 14, 1992, to Long et al. teaches a spray paint shield for manually protectively covering a portion of a wall or ceiling when the adjoining ceiling or wall portion, respectively, is being spray painted. The spray shield includes a generally flat, elongated sheet of thin, flexible material such as stainless steel or aluminum, having a straight distal or working edge and an elongated handle pivotally connected to, and extending from, the flat sheet at a mid point of the edge of the flat sheet opposite its distal edge. The handle is lockably positionable within the plane defined by the flat sheet at any convenient acute angle to the distal edge.

U.S. Patent Office Document No. 2005/0035221 A1, Published/Issued on Feb. 17, 2005, to Gathright teaches a paint shield that includes two rigid sheets of material which are joined in a perpendicular orientation. The angle of this joint matches the angle of an interior room wall to wall corner. The paint shield also includes an elongated handle mounted between the sheets and angling away from the joint. The handle may have a telescopic capability. The handle may also be positioned closer to a particular wall. The angle of the handle allows ambidextrous use of the paint shield, while providing unhampered excess for spray painting the ceiling or floor corner. A painter may hold the shield against a wall corner, while spray painting the exposed ceiling or floor and masking the protected wall surfaces.

U.S. Patent Office Document No. 7,063,275 B2 Published/Issued on Jun. 20, 2006, to Byron teaches a sprayer having a spray shield and a spray shield retainer. The spray shield is removably attached to the spray shield retainer for efficient storage when not in use. The spray shield can be contoured to the body of the sprayer. The spray shield is configured for attached to a spray wand proximate to a nozzle.

It is apparent now that different paint shields are present in the prior art that are adequate for various purposes. However, the aforementioned references do not disclose the elements of embodiments of the present invention and fail to contemplate the unique and advantageous aspects of various embodiments of the invention. Furthermore, even though the prior art devices would not be suitable for the purposes of embodiments of the present invention as heretofore described.

SUMMARY OF THE INVENTION

Certain embodiments of the present invention provide a paint spray guide that dramatically decreases the time required for painting edges and is simple to use.

One embodiment of the present invention provides a paint spray guide for a swivel angle head located between a spray wand of a paint sprayer and a spray nozzle which comprises an arm having a first end and a second end. A mechanism is for removably attaching the first end of the arm to the swivel angle head, so that the arm will extend over the swivel angle head and the spray nozzle. A wheel is also provided. Another mechanism is for rotatably connecting the wheel to the second end of the arm. When an edge of the wheel is placed in a corner joint between a wall and a ceiling and the spray wand is manually moved therealong, the wheel will rotate in the corner joint to allow paint to be evenly sprayed from the spray nozzle onto an area of the wall adjacent to the ceiling.

The novel features which are considered characteristics of certain embodiments of the present invention are set forth in the appended claims. Embodiments of the invention relating to construction and method of operation embodiments, together with additional advantages thereof, will be best understood from the following description of the specific embodiments when read and understood in connection with the accompanying drawing.

BRIEF DESCRIPTION OF THE DRAWING

The figures of the drawings are briefly described as follows.

DETAILED DESCRIPTION

Figure 1:
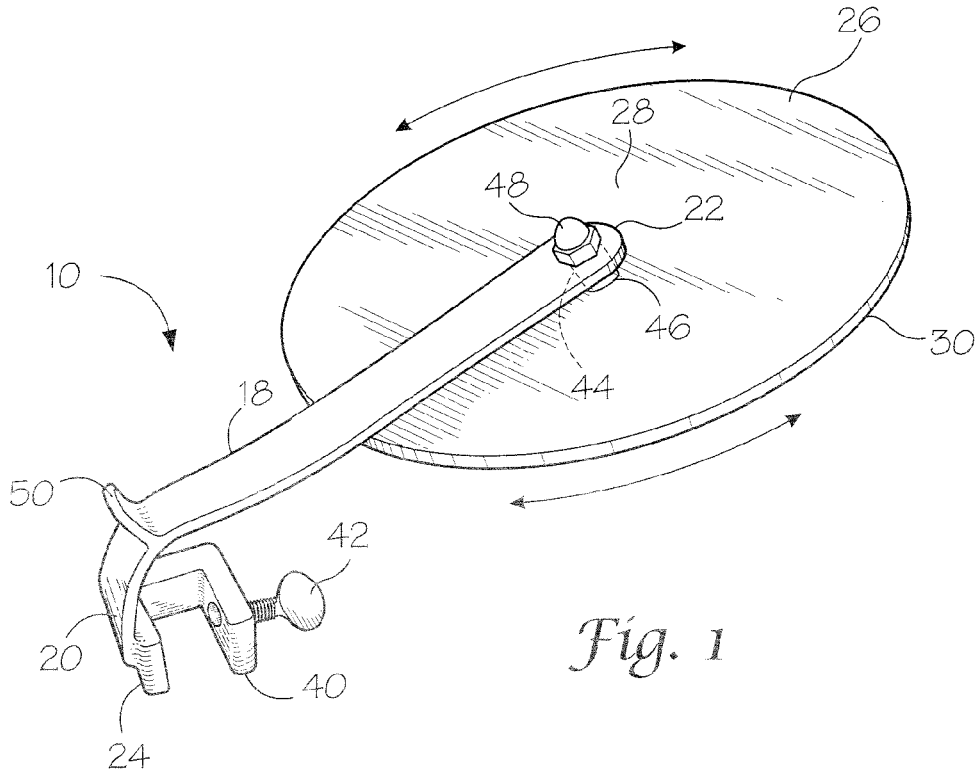
FIG. 1 is a rear perspective view of an embodiment of the present invention per se.
Figure 2:
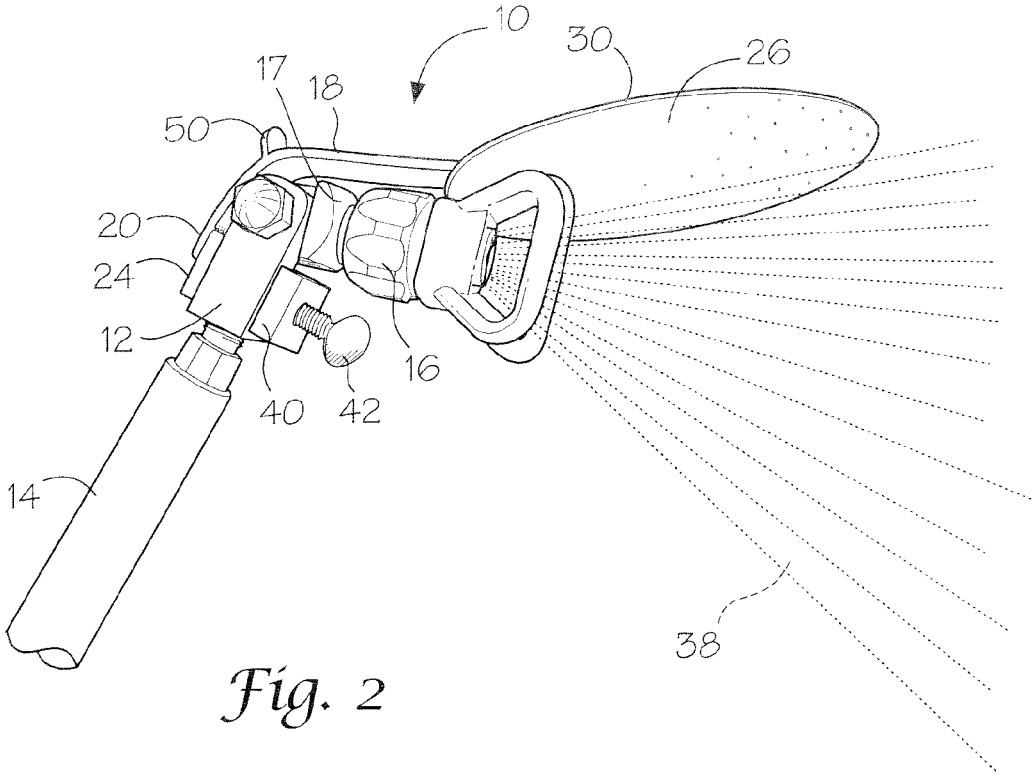
FIG. 2 is a side perspective view of an embodiment of the present invention attached to a swivel angle head located between a spray wand of a paint sprayer and a spray nozzle.
Figure 3:
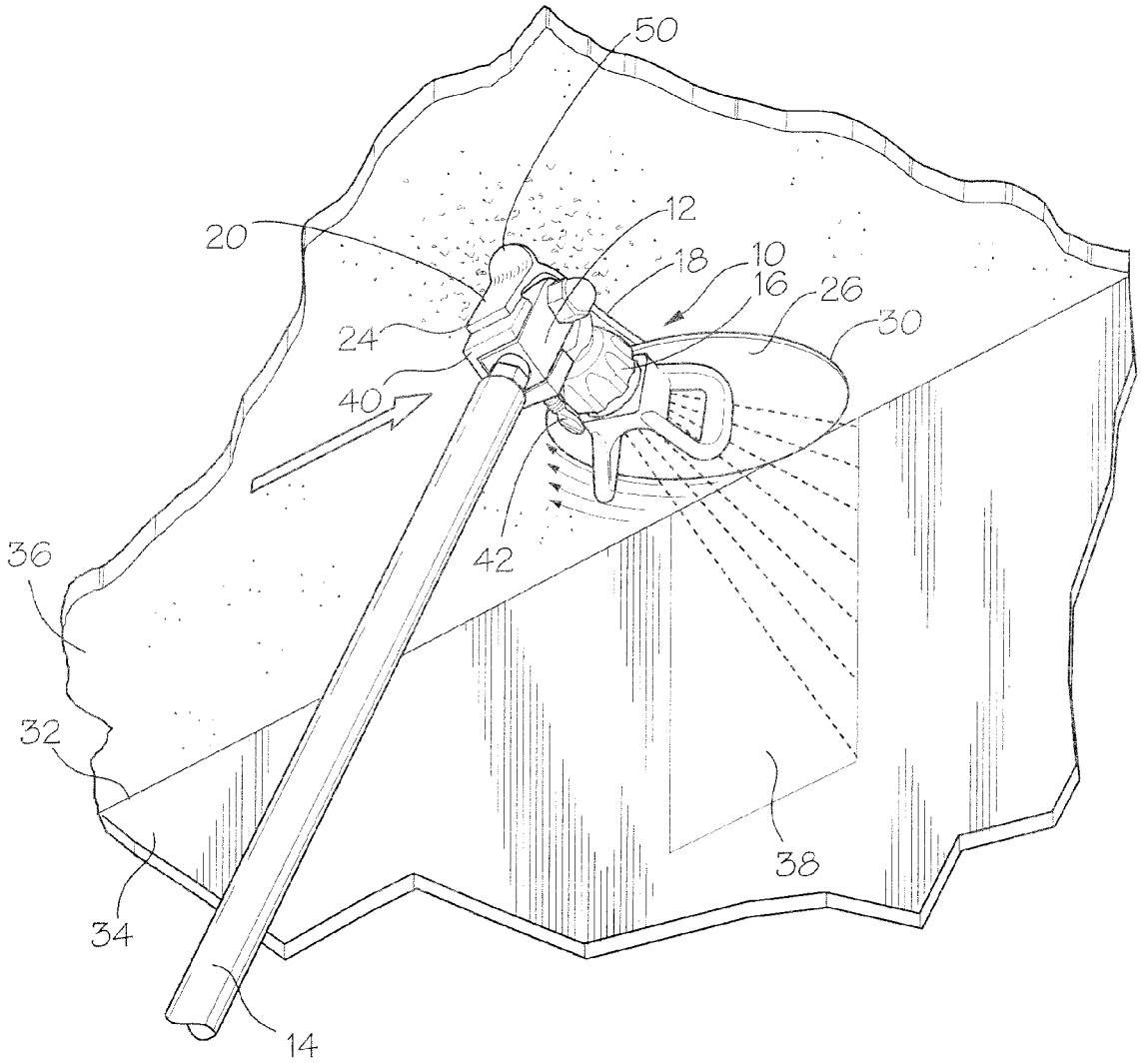
FIG. 3 is a bottom perspective view showing an embodiment of the present invention in use when paint is sprayed on a wall adjacent to a ceiling.

Referring now to the figures, in which like numerals indicate like parts, and particularly to FIGS. 1 through 3, which are a rear perspective view of an embodiment of the present invention per se; a side perspective view of an embodiment of the present invention attached to a swivel angle head located between a spray wand of a paint sprayer and a spray nozzle; and a bottom perspective view showing an embodiment of the present invention in use when paint is sprayed on a wall adjacent to a ceiling, and as such, will be discussed with reference thereto.

According to one embodiment, the present invention pertains to a paint spray guide 10 for a spray assembly 11 comprising a swivel angle head 12 located between a spray wand 14 of a paint sprayer (not shown) and a spray nozzle 16. The paint spray guide 10 comprises an arm 18 having a first end 20 and a second end 22. A mechanism 24 is for removably attaching the first end 20 of the arm 18 to the swivel angle head 12, so that the arm 18 will extend over the swivel angle head 12 and the spray nozzle 16. A wheel 26 is also provided. Another mechanism 28 is for rotatably connecting the wheel 26 to the second end 22 of the arm 18. When an edge 30 of the wheel 26 is placed in a corner joint 32 between a wall 34 and a ceiling 36 and the spray wand 14 is manually moved therealong, the wheel 26 will rotate in the corner joint 32 to allow paint 38 to be evenly sprayed onto an area of the wall 34 adjacent to the ceiling 36 from the spray nozzle 16.

The removably attaching mechanism 24 comprises a C-clamp member 40 affixed to the first end 20 of the arm 18. A thumbscrew 42 is threaded into the C-clamp member 40. When the thumbscrew 42 is tightened, the C-clamp member 40 will become attached to the swivel angle head 12. The wheel 26 is sized to prevent paint 38 sprayed from the spray nozzle 16 to make contact with the ceiling 36 when the wall 34 adjacent to the ceiling 36 is being painted. The C-clamp is believed to be a sturdy and facile means for attaching the spray guide. However, it is contemplated that other configurations for attaching the spray guide to the spray assembly may be implemented, such as, but not limited to, a nut and bolt through the spray assembly and through the arm, a hose clamp surrounding the spray assembly and holding the arm thereto, a slot defined in the assembly for the arm to slide into, or a flat extension on the spray assembly for sliding into a slot defined on the arm, etc.

The rotatably connecting mechanism 28 comprises the second end 32 of the arm 18 having an aperture 44 therethrough. A stub shaft 46 is mounted on the center of the wheel 26. The stub shaft 46 extends upwardly through the aperture 44 in the second end 22 of the arm 18. A fastener 48 engages with the stub shaft and holds the wheel 26 to the second end 22 of the arm 18 while allowing the wheel 26 to rotate.

In an alternative embodiment, the paint spray guide 10 further comprises a curved bumper member 50 affixed to and extending upwardly from the arm 18 near the removably attaching mechanism 24. The curved bumper member 50 will bear against the ceiling 36 to properly position the spray nozzle 16 towards the area of the wall 34 adjacent to the ceiling 36. The arm 18, the removably attaching mechanism 24, the wheel 34, the rotatably connecting mechanism 28 and the curved bumper member 50 are all fabricated out of a stainless steel material. Those skilled in the art will appreciate that a some or all of the components can be made from other suitable materials including, but not limited to, plastics, wood, other metals and alloys etc., or a combination thereof. In another alternative embodiment, the curve member may be substituted with any suitable extended structure from said arm that facilitates the maintenance of an even bearing across a surface, including but not limited to a wheel attached to the arm 18 between said first and second arm ends 20, 22.

In other embodiments, the swivel head has an orthogonal structure other than a square or rectangular structure, such as but not limited to, pentagonal, hexagonal, etc. or a rounded structure, e.g. cylindrical. While the embodiment described for FIGS. 1-3 above includes a swivel angle head that associates the spray nozzle to the spray wand, the assembly is not limited to including a swivel head or any head. Those skilled in the art, in view of the teachings herein will appreciate that there are many types of assemblies that associate a spray nozzle with a spray wand, including, but not limited to, some that may swivel, some that may be generally square or rectangular, such as that shown in the drawings, some may be cylindrical, or, in certain embodiments, the assembly comprises a direct connection between the spray nozzle and the end of a wand without an intervening head, per se.

Figure 4:
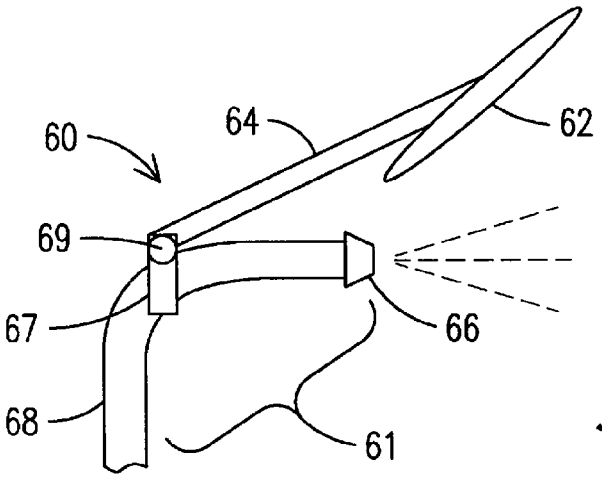
FIG. 4 shows a side perspective of another embodiment of the present invention.

In another alternative embodiment as shown in FIG. 4, a spray guide 60 is designed for implementation with a spray assembly 61 that comprises a nozzle 46 engaged directly to a wand 68. The nozzle may be rotated or adjusted. The spray guide 60 comprises a wheel 62 rotatably attached to an arm 64. The arm 64 is attached to the spray assembly 61 via implementation with a clamp 67 tightened around the wand 68. The arm 64 is pivotably engaged to the clamp 67 by a hinge 69. The wheel of spray guide 60 (or 10) is adjusted so that the spray slightly fogs the edge of the wheel. This avoids build up of fluid on the wheel, which can result in dripping.

Figure 5A:
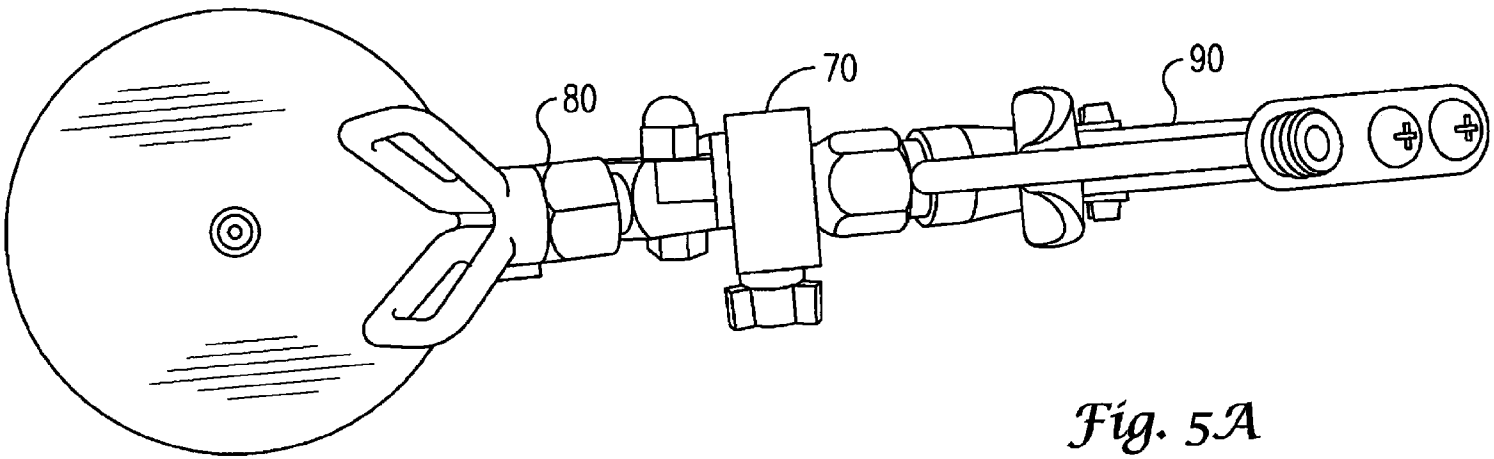
FIG. 5. shows a bottom perspective view 5(*a*) and a top perspective view 5(*b*) of a handheld embodiment of the present invention.
Figure 5B:
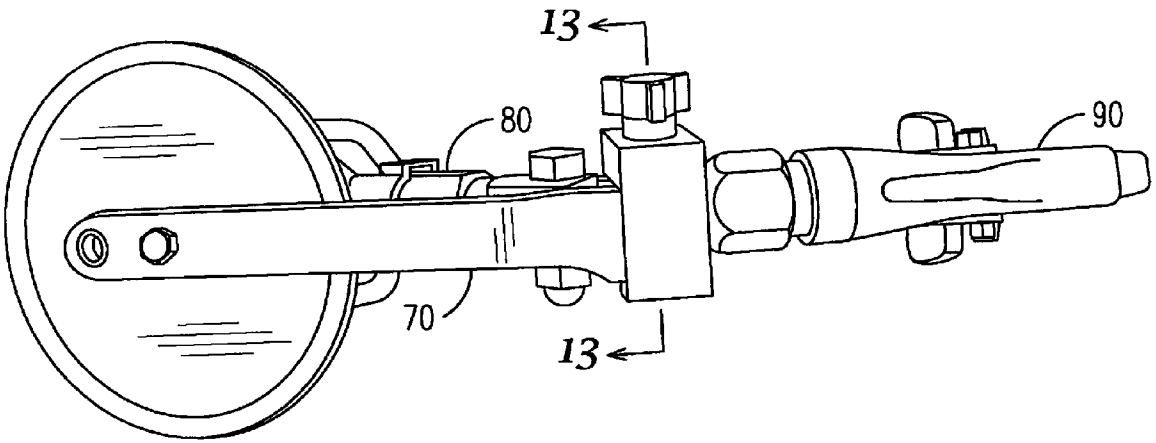
Figure 6:
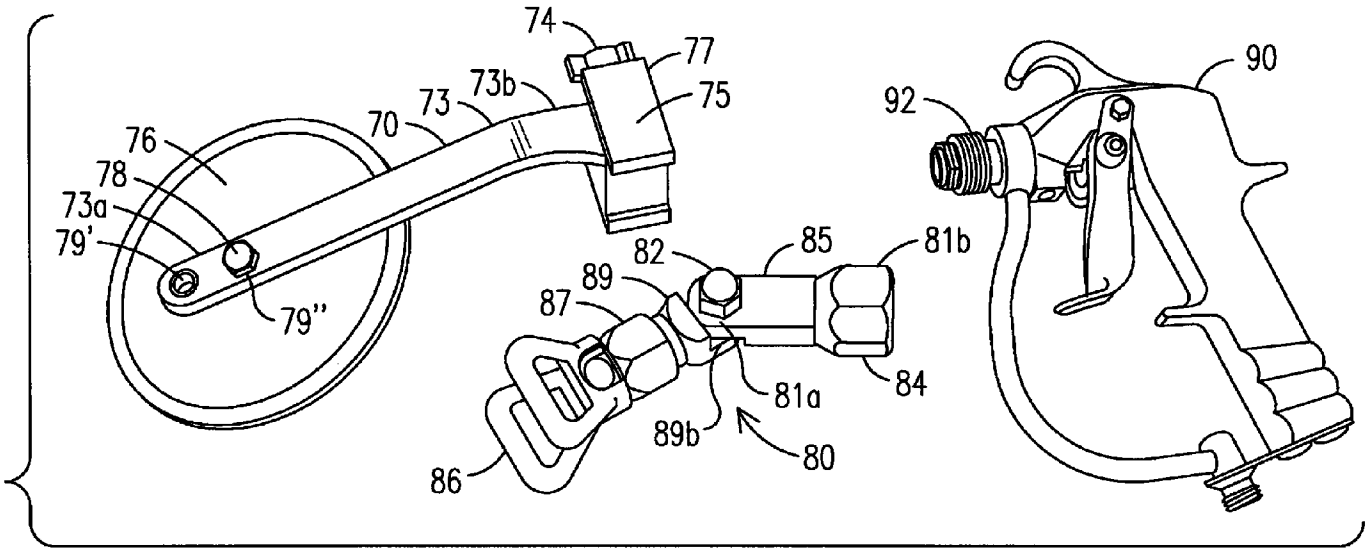
FIG. 6. shows a perspective view of a disassembled embodiment of the present invention.
Figure 7:
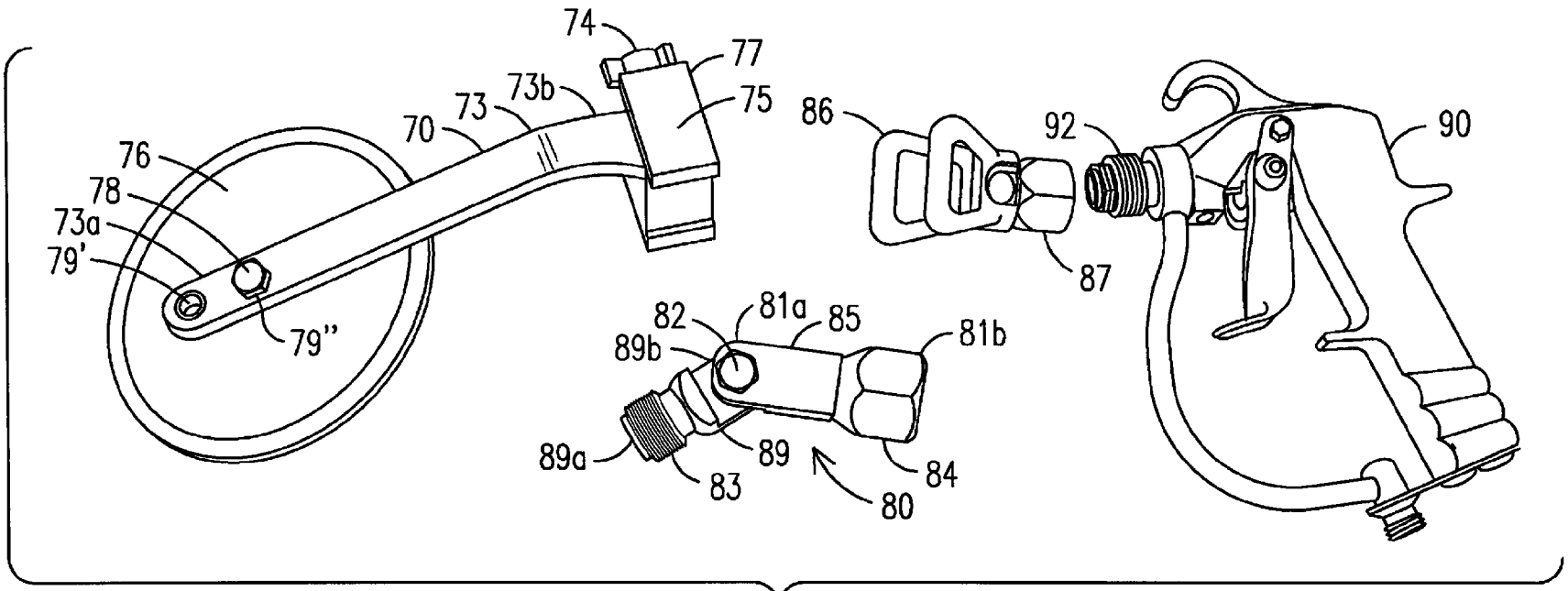
FIG. 7 shows a perspective view of a disassembled embodiment of the present invention.

Referring now to FIGS. 5-7, a spray guide embodiment 70 and spray nozzle assembly embodiment 80 for use with a handheld sprayer 90 will be discussed. FIG. 5 shows a top view (5*a*) and a bottom view (5*b*) of the spray guide embodiment 70 attached to the spray nozzle assembly 80. The spray nozzle assembly is connected to the handheld sprayer 90. FIG. 6 shows a disassembled view of the spray guide 70, spray nozzle assemble 80 and handheld sprayer. FIG. 7 shows a further disassembled view of the spray nozzle assembly 80. The spray guide 70 has a wheel 76 attached to arm 73 at its distal end (73*a*). The arm includes two attachment holes 79' and 79" through which a lug 78 passes through and attaches the arm 73 to the wheel 76. The attachment holes 79' and 79" are spaced apart to allow for adjustment of the wheel 76 in relation to the arm 73.

The spray nozzle assembly 80 includes a base 85 having a distal end (81*a*) and proximal end (81*b*) and a spray linkage 89 having a distal end (89*a*) and proximal end (89*b*). The spray linkage 89 is pivotably attached to the base 85 at the proximal end 89*b* and distal end 81*a*. Shown is a nut 82 which is attached to a bolt (not shown) that is associated with 89*b* and 81*a*. In FIG. 6, the spray nozzle 87 is connected to the distal end of the spray linkage 89*a*. The distal end 89*a* of the spray linkage 89 includes threads 83 facilitating connection of the spray nozzle 87. Attached to the spray nozzle is a spray guard 86.

The base 85 has a sprayer connector 84 at its proximal end 81*a* for connecting the base to the sprayer 90. The sprayer 90 comprises threads 92 for facilitating connection of the base 85 to the sprayer 90.

Figure 13:
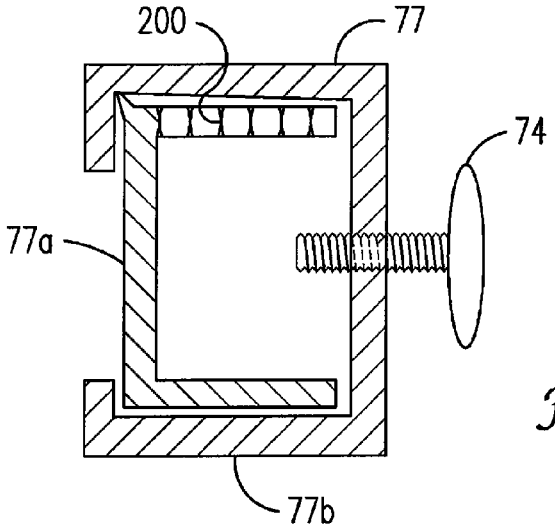
FIG. 13 shows a cross section along lines Z-Z in FIG. 5*b*.

At its proximal end (73*b*), the arm 73 is attached to a clamp 77. FIG. 13 shows a cross-sectional view of the clamp, as shown in FIG. 5 along lines Z-Z. The clamp 77 associates with the base 85 (not shown). As shown, the clamp 77 includes a tightener 74 for securing the clamp 77 to the base. The clamp 77 comprises two clamp components 77*a* and 77*b*. The tightener 74 screws through component 77*b* and pushes against base 85 (not shown) which pulls the two clamp components 77*a* 77*b* together. The cross-hatch markings 200 represent the cut-away where the arm 73 extends.

Figure 14:
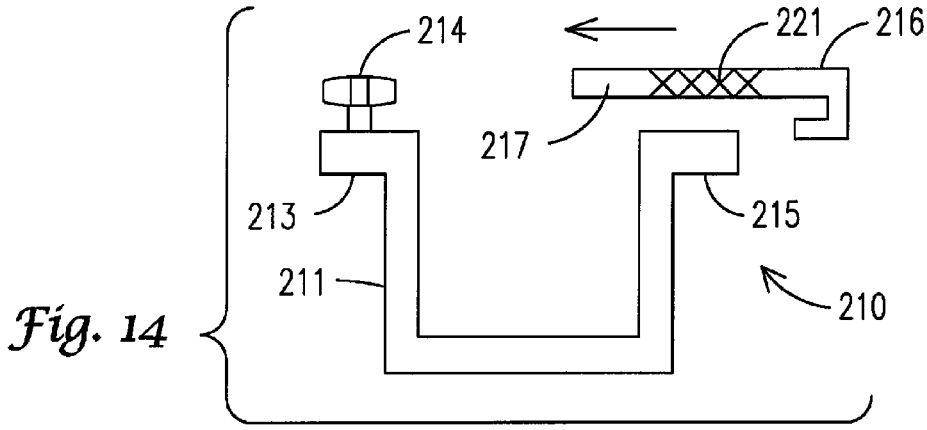
FIG. 14 shows a side view of an alternative clamp embodiment.
Figure 15:
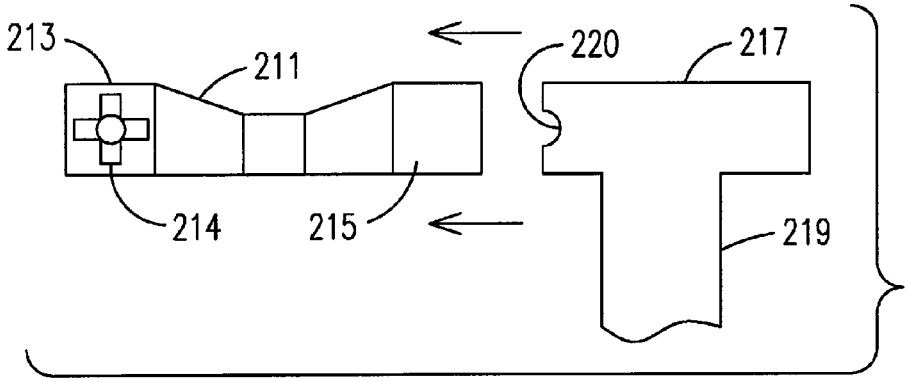
FIG. 15 shows a top view of the alternative clamp embodiment shown in FIG. 14.

FIGS. 14 and 15 show an alternative clamp embodiment 210. A base clamp component 211 is generally U shaped and comprises tabs 213, 215. On top of tab 213, a removably fastener 214 is engaged. An arm piece 216 of the spray guide, with connecting piece 217 and arm piece (cut off at wavy line) 219, slides over the base clamp component 211 and is secured to the base clamp component 211 via fastener 214 at notch 220. The hatch marks 221 on arm piece 216 represent where the arm piece 219 extends from the connecting piece 217.

Figure 8:
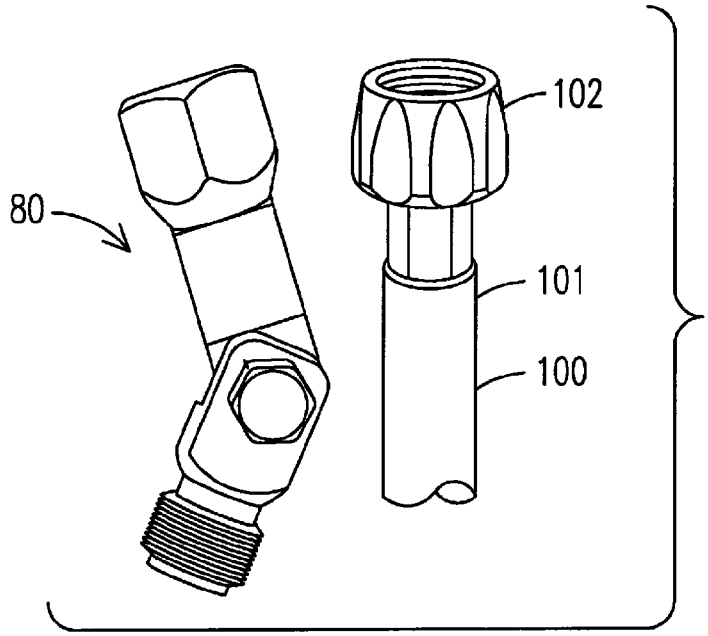
Fig. 8 PRIOR ART
FIG. 8 shows a side perspective view of attachment embodiments of the present invention.

FIG. 8 shows a prior art spray wand 100 at its the proximal end 101. The proximal end 101 has a prior art connector 102 that typically attaches to a hose for delivering fluid (not shown). Also shown is the spray nozzle assembly 80 for comparison purposes.

Figure 10:
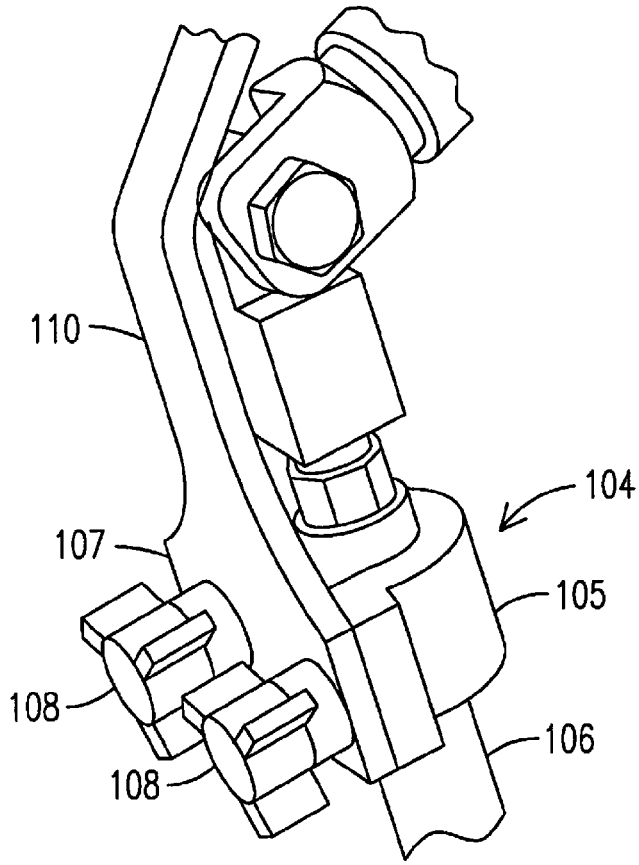
FIG. 10 shows a side perspective view of a clamp embodiment of the present invention.
Figure 9:
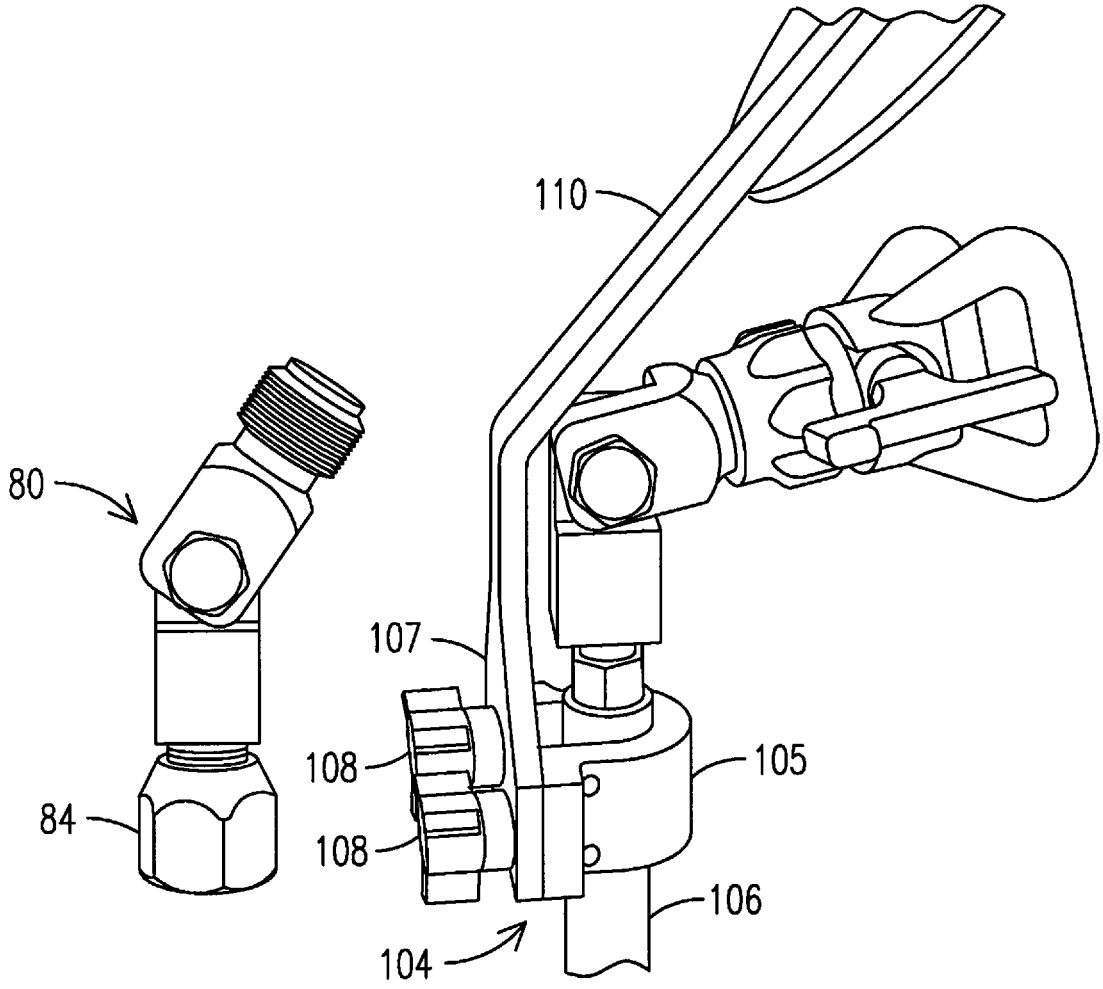
FIG. 9 shows a side perspective view of attachment embodiments of the present invention.

FIGS. 9 and 10 show a clamp arrangement 104 designed for attaching a spray guide embodiment 110 to a cylindrical shaft 106 of a spray wand. The spray guide 110 has a "C" bracket 105 that goes around the wand 106. The bracket 105 secures to the proximal end 107 of the spray guide via the two fasteners 108 that pass through holes in the guide 110 (not shown) and fasten into the bracket 105. FIG. 9 also shows the spray nozzle assembly 80 with the spray connector 84 discussed above.

Figure 11:
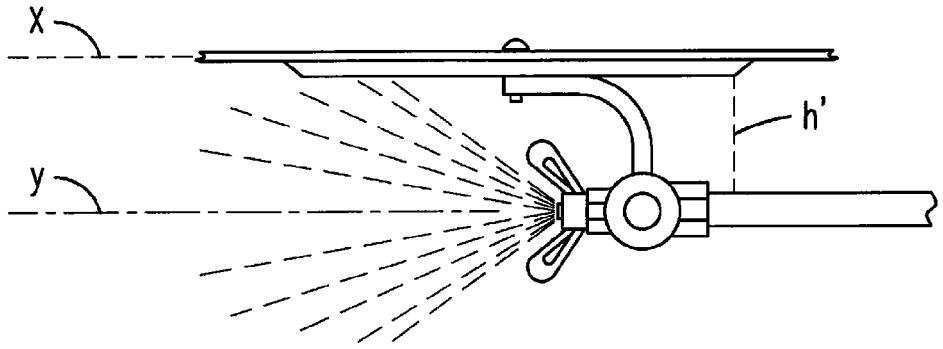
Fig. 11 PRIOR ART
FIG. 11 shows a prior art spray guide device.
Figure 12:
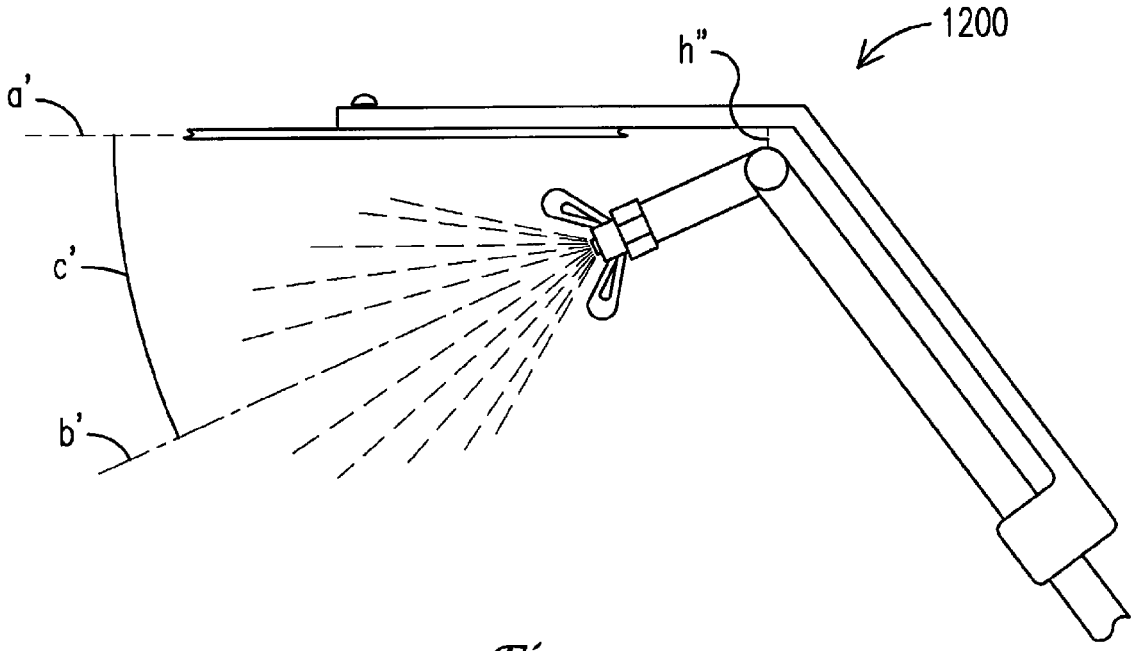
FIG. 12 shows a side view of a spray guide embodiment of the present invention.

FIG. 11 shows a prior art guide design. The prior art design has a height h'. Furthermore, the vectors x and y are parallel. The prior art guide cannot be adjusted to avoid overspray around the end of the wheel. FIG. 12 shows an embodiment 1200 of the invention that avoids a number of problems inherent in the prior art guide. The embodiment 1200 has an arrangement establishes a height h" between the arm and the pivot point of the nozzle assembly. The embodiment also includes a vector of the wheel a' and the nozzle b' that form an acute angle c'. It is noted that the pivot point of the nozzle is independent of the arm of the spray guide. Typically, the bend in the spray guide arm is proximate to the pivot point of the nozzle. The height and/or angle of spray allows for the nozzle to be pointed at an angle that avoids overspray around the end of the wheel but which also allows the production of an even line at right angled surfaces, such as between a floor and a side wall, or side wall and ceiling. The embodiment 1200 enables superior results in forming straight lines of fluid coverage and achieves this in a much easier manner.

Those skilled in the art will appreciate, based on the teachings herein, that components of the embodiments described herein may be made of various suitable materials, including but not limited to, metals, plastics including polymers, resins, etc, or wood. Furthermore, the embodiments may comprise certain component(s) made of one or more materials, and other component(s) made of other one or more materials.

It is apparent in view of the teachings herein that embodiments of the invention are particularly useful for applying paint to a surface comprising a corner. It will be understood that embodiments of the invention can be useful for the application of any suitable fluid, whether paint or otherwise, that is sprayed onto a surface of a fluid spraying system comprising a wand and nozzle.

It will be understood that each of the elements described above, or two or more together, may also find a useful application in other types of constructions differing from the types described above.

While the invention has been illustrated and described as embodiments of a spray guide, accordingly it is not limited to the details shown, since it will be understood that various omissions, modifications, substitutions and changes in the forms and details of the device illustrated and its operation can be made by those skilled in the art without departing in any way from the spirit of the present invention. The teachings of all of the references cited herein are incorporated by reference to the extent not inconsistent with the teachings herein.

What is claimed is:

1. A pivotable spray nozzle assembly, said pivotable spray nozzle assembly comprising:

a base having a distal end and proximal end;

a spray linkage having a distal end and proximal end; said spray linkage being pivotably attached to the base at the base distal end and linkage proximal end, thereby forming a pivot point;

a spray nozzle connected to the spray linkage distal end;

a sprayer connector attached to the base proximal end for connecting the spray nozzle assembly to a handheld fluid sprayer;

a spray guide associated with said spray nozzle assembly at said base, said spray guide comprising i) an arm having a distal end and a proximal end;

ii) a first connector for removably attaching said proximal end of said arm to the base;

iii) a wheel; and iv) a second connector for rotatably connecting said wheel to said distal end of said arm;

wherein said pivot point and said arm are independent from each other and arranged so as to establish a height between said pivot point and said arm, said height comprising a distance of 0.2 to 2.0 inches; and wherein the vector of said wheel and the vector of said spray nozzle form an acute angle;

whereby said height and angle allows for the spray nozzle to be pointed so as to avoid overspray around the wheel while producing an even line at right-angled surfaces.

2. The pivotable spray nozzle assembly of claim 1, wherein said arm has two or more holes for accommodating said second connector, wherein the holes are spaced apart to allow adjustment of the wheel respective to said arm.

3. The pivotable spray nozzle assembly of claim 1, wherein said first connector is a clamp comprising a tightener for securing said guide to said base.

* * * * *